US008689783B2

(12) United States Patent
Cosentino et al.

(10) Patent No.: US 8,689,783 B2
(45) Date of Patent: Apr. 8, 2014

(54) COOKING APPARATUS FOR INSERTION INTO A CUT-OUT IN A WORK TOP AND METHOD FOR MOUNTING TWO COOKING APPARATUSES THAT CAN BE ARRANGED ADJACENTLY IN A SHARED CUT-OUT IN A WORK TOP

(75) Inventors: Anne-Francoise Cosentino, Lingolsheim (FR); Jürgen Desor, Strasbourg (FR); Sebastien Dubois, Ernolsheim sur Bruche (FR); Guillaume Hoffbeck, Ottrott (FR); Dzmitry Kucharavy, Strasbourg (FR); Gael Mollet, Duttlenheim (FR); Gildas Violain, Hilsenheim (FR); Virginie Willmes, Fegersheim (FR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/522,515

(22) PCT Filed: Dec. 29, 2010

(86) PCT No.: PCT/EP2010/070878

§ 371 (c)(1), (2), (4) Date: Sep. 13, 2012

(87) PCT Pub. No.: WO2011/088959

PCT Pub. Date: Jul. 28, 2011

(65) Prior Publication Data

US 2012/0325824 A1 Dec. 27, 2012

(30) Foreign Application Priority Data

Jan. 22, 2010 (EP) ..... 10290029

(51) Int. Cl.
*F24B 13/02* (2006.01)

(52) U.S. Cl.
CPC ..... *F24B 13/02* (2013.01)
USPC ..... 126/219; 220/573.1

(58) Field of Classification Search
CPC ..... F24B 13/02
USPC ..... 220/573.1; 126/219, 218, 217, 212
See application file for complete search history.

(56) References Cited

U.S. PATENT DOCUMENTS

| | | | |
|---|---|---|---|
| 3,679,870 A | 7/1972 | Opp | |
| 5,549,098 A | 8/1996 | Bales et al. | |

FOREIGN PATENT DOCUMENTS

| | | | | |
|---|---|---|---|---|
| DE | 102008017776 A1 | 10/2008 | | |
| EP | 2144009 A1 | 1/2010 | | |
| FR | 2678358 A3 | 12/1992 | | |
| JP | 58110932 A * | 7/1983 | ..... | F24C 11/00 |
| JP | 2005312968 A * | 11/2005 | ..... | A47J 27/00 |

OTHER PUBLICATIONS

International Search Report PCT/EP2010/070878.

* cited by examiner

*Primary Examiner* — Robert J Hicks

(74) *Attorney, Agent, or Firm* — James E. Howard; Andre Pallapies

(57) ABSTRACT

A cooking appliance for insertion into a cut-out in a work top includes a peripheral lateral wall having four wall sections. Each wall section has on the outer face thereof at least one resiliently deformable compression element. Two such cooking appliances disposed adjacently in the shared cut-out in the work top can be mounted by inserting a first one of the two cooking appliances into the cut-out. An intermediate wall is arranged on a free face of the first cooking appliance so that compression elements of the first cooking appliance adjoining the intermediate wall engage in a first group of recesses in the intermediate wall, and a second one of the two cooking appliances is inserted into the cut-out so that compression elements of the second cooking appliance adjoining the intermediate wall engage in a second group of recesses in the intermediate wall.

17 Claims, 3 Drawing Sheets

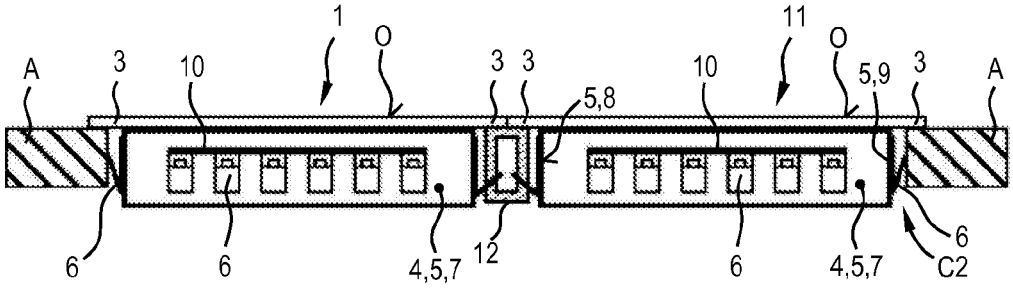
Fig.4
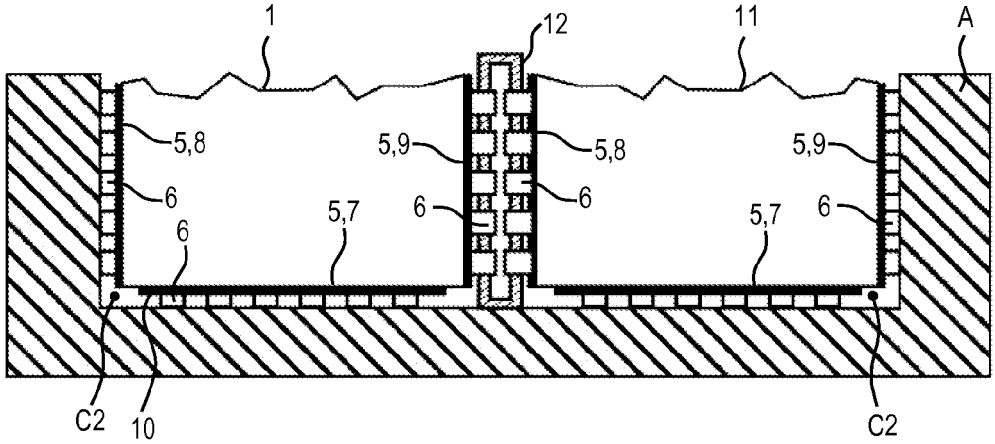
Fig.5
Fig.6
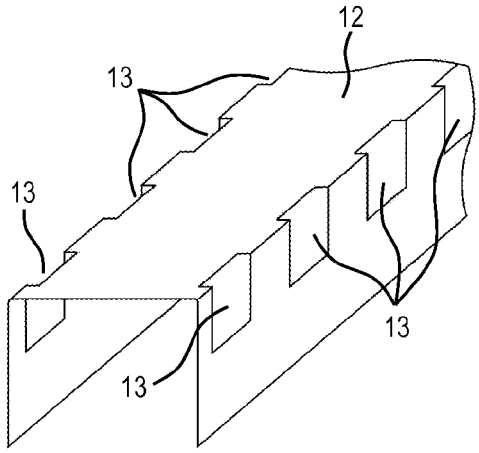

COOKING APPARATUS FOR INSERTION INTO A CUT-OUT IN A WORK TOP AND METHOD FOR MOUNTING TWO COOKING APPARATUSES THAT CAN BE ARRANGED ADJACENTLY IN A SHARED CUT-OUT IN A WORK TOP

The invention relates to a cooking appliance for insertion into a cut-out in a work top. The invention also relates to a method for mounting two cooking appliances that can be disposed adjacently in a shared cut-out in a work top, with each of the cooking appliances having a peripheral side wall with four wall sections.

A typical cooking appliance provided for insertion into a cut-out in a work top, e.g. a cook top, has a box-shaped housing, in which functional elements of the cook top are accommodated, with a laterally projecting edge extending on an upper face. The box-shaped housing is lowered into the cut-out and rests with the edge on the work top. For fastening purposes until now said cooking appliance has generally been fastened to the work top from below, e.g. by screw connections. Mounting, particularly from below, is complex and time-consuming. It is frequently not possible to ensure that the cooking appliances are held and positioned correctly. The thickness of the work top can also be a problem.

The object of the present invention is to eliminate the disadvantages of the prior art at least to some extent and in particular to provide a means of fastening a cooking appliance in a work top, which is particularly simple to construct and apply.

This object is achieved according to the features of the independent claims. Preferred embodiments will emerge in particular from the dependent claims.

The object is achieved by a cooking appliance for insertion into a cut-out in a work top, with the cooking appliance having a peripheral side wall with four wall sections and each of the wall sections having at least one resiliently deformable compression element on its outer face.

Adjacent wall sections can be at an angle to one another, for example being angled at right angles to one another in the case of a rectangular side wall. The wall sections can be straight but do not have to be. In the case of a rectangular side wall the wall sections correspond for example to a front face, a rear face a left face and a right face of the side wall.

The at least one resiliently deformable compression element can be used to hold the cooking appliance in a press fit on all sides in the work top when it is inserted into the cut-out in the work top by compressing the compression elements. Fastening can be achieved by simply inserting or pushing the cooking appliance into the work top even without tools. The cooking appliance is self-aligning due to the tendency of the compression elements to deform in a regular manner. Since only a force fit and not a form fit results between the cooking appliance and the work top, the cooking appliance can be removed from the work top again by simply pushing it out. The thickness of the work top is not a problem, as fastening takes place at an edge of the cut-out.

The cooking appliance can be a cook top in particular, e.g. a gas cook top, a radiant cook top or an induction cook top.

In one embodiment each of the wall sections has at least two resiliently deformable compression elements on its outer face. The use of at least two compression elements per wall section has the advantage that final positioning of the cooking appliance is based on at least two points and corresponding compression elements on each side, thereby allowing compensation for unevenness or other local defects in the cut-out. The more compression elements there are on a wall section, the greater the degree to which the local defects in the cut-out, which may originate from cutting for example, can be corrected.

The at least two compression elements can be disposed in particular at an equal distance one in front of the other in a row along the wall section.

In a further embodiment the at least one compression element is present in the form of a bent spring element. Resilient compression is brought about by compression of the compression element. The use of a bent spring element has the advantage that it can be produced in a compact and simple manner and can also be inserted into the work top essentially without damage or function-impairing tilt. The bent spring element can be embodied in particular as a bent fin. However the at least one compression element is not limited to this but can be present for example as a differently structured, in particular metallic, spring element or even as a compact resilient volume, made of rubber for example.

In one particular embodiment the at least one compression element is present in the form of a spring element bent in a V shape or U shape. Such a spring element is particularly simple to produce and can be adjusted precisely in respect of its spring force and its spring deflection.

In one particular embodiment a closed face of the at least one bent spring element points downward. This excludes damage or tilt particularly reliably and the compression elements do not have to be handled further, e.g. compressed beforehand, when the cooking appliance is inserted. Alternatively however for example an open face of the at least one bent spring element can also point downward, facilitating removal of the cooking appliance.

The object is also achieved by a system consisting of a number of cooking appliances which can be inserted adjacent to one another into a cut-out in a work top as described above.

With these two adjacent cooking appliances the compression elements, which are located on the respective face facing away from the contact edge, allow the two cooking appliances to be brought into contact simply without a gap.

In one development the system also has at least one intermediate wall, which is disposed between two cooking appliances as described above, with the intermediate wall having at least one recess for the introduction of adjoining compression elements of the two cooking appliances. In other words the intermediate wall can have at least one recess on each face facing one of the cooking appliances, so that the at least one compression element of the wall section of the respective cooking appliance facing the intermediate wall can engage in the at least one recess. This allows the two cooking appliances to be aligned with one another precisely in a simple manner, in particular to be joined together in a flush manner. The width and interval of the compression elements and associated recesses is arbitrary.

In a further development the at least one recess and the associated at least one compression element are characterized in that there is essentially no force fit between them.

In another development the compression elements of opposing wall sections of the at least two adjacently disposed cooking appliances can mesh with one another. This dispenses with the need for an intermediate wall. To this end adjacent compression elements can in particular have an interval, which corresponds to their width. The compression elements of adjacently disposed cooking appliances are offset appropriately from one another, e.g. by a half period.

The object is also achieved by a method for mounting two cooking appliances that can be disposed adjacently in a shared cut-out in a work top, with each of the cooking appliances having a peripheral side wall with four wall sections. The method has at least the following steps:

insertion of a first of the two cooking appliances into the cut-out;

arrangement of an intermediate wall on a free face of the first cooking appliance so that compression elements of the first cooking appliance adjoining the intermediate wall engage in a first group of recesses in the intermediate wall; and insertion of a second of the two cooking appliances into the cut-out so that compression elements of the second cooking appliance adjoining the intermediate wall engage in a second group of recesses in the intermediate wall.

The object is also achieved by a method for mounting two cooking appliances that can be disposed adjacently in a shared cut-out in a work top, with each of the cooking appliances having a peripheral side wall with four wall sections. The method has at least the following steps:

insertion of a first of the two cooking appliances into the cut-out;

insertion of a second of the two cooking appliances into the cut-out adjacent to the first cooking appliance so that opposing compression elements of the two cooking appliances mesh with one another.

BRIEF DESCRIPTION OF THE DRAWINGS

The invention is described schematically in more detail in the figures below based on exemplary embodiments. Identical elements or elements with an identical effect can be provided with identical reference characters for the sake of clarity.

FIG. 4 shows a sectional side view of two cook tops inserted adjacently into a work top;

FIG. 5 shows a sectional view along a surface of the work top looking down on the cook tops inserted into the work top;

FIG. 6 shows an oblique view cut out from an intermediate wall, which is disposed between the two cook tops from FIG. 4 and FIG. 5;

DETAILED DESCRIPTION OF EXEMPLARY EMBODIMENTS OF THE PRESENT INVENTION

Figure 1:
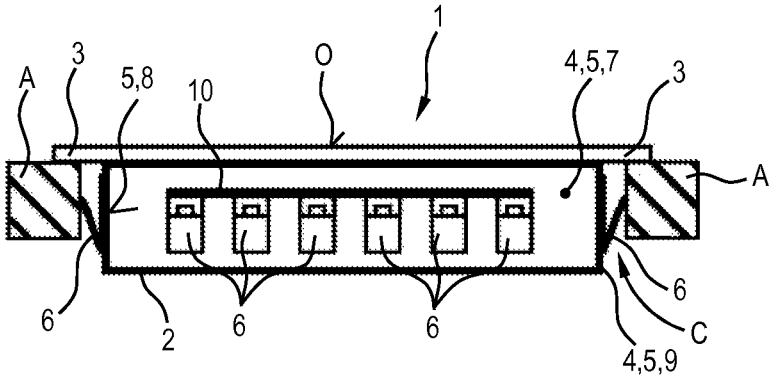
FIG. 1 shows a sectional side view of a cook top inserted into a work top.
Figure 2:
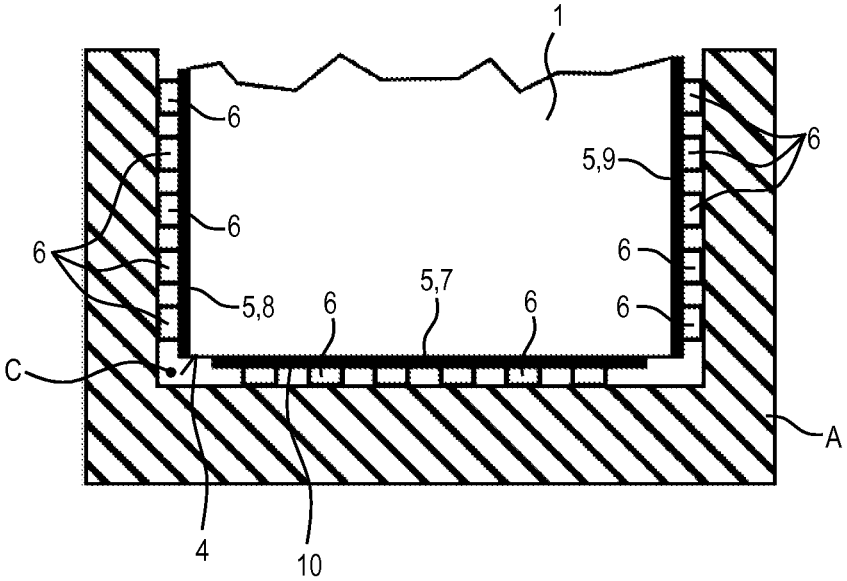
FIG. 2 shows a sectional view cut out along a surface of the work top looking down on the cook top inserted into the work top.

FIG. 1 shows a sectional side view of a cooking appliance inserted into a cut-out C in a work top A in the form of a cook top 1. The cut-out C is essentially rectangular when viewed from above. The cook top 1 here has a box-shaped housing 2, in which functional elements of the cook top 1 are accommodated, in particular the hotplates on the upper face. An edge 3 projects laterally and extends on an upper face O. As shown from above in a front-face cut-out in FIG. 2, the housing 2, when viewed from above, has essentially the same shape as the cut-out C, but is smaller. The edge extends laterally over the cut-out C to the work top A. The work top A can thus be let into the cut-out C from above and rests with the edge 3 on the work top A.

To fasten the cook top 1 in the cut-out C, a number of resiliently deformable compression elements 6 are disposed respectively on an outer face 4 of the peripheral side wall 5 of the housing 2. More precisely a number of the compression elements 6 are present respectively on each of the straight wall sections (front face 7, rear face, left face 8 and right face 9). In the inserted state shown each of the compression elements 6 pushes against the work top A so that it is held by the sum of the pressure forces of the compression elements 6 as well as by the force of its weight. The compression forces also help to position the cook top 1 on all sides, as greater proximity to the work top A produces a greater compression force and the cook top 1 is pushed away from the cook top A locally to a greater degree. Local unevenness in the cut-out C is also leveled out by the many (e.g. six or more) compression elements 6 when force is considered.

Figure 3:
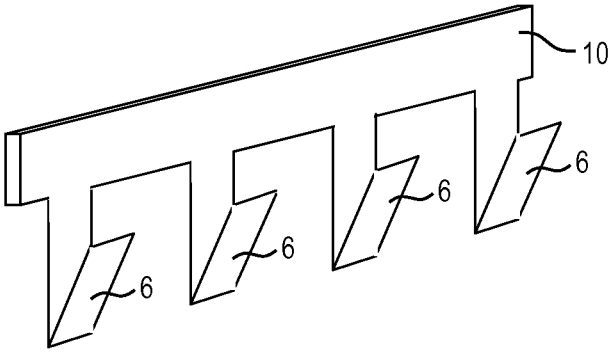
FIG. 3 shows an oblique view of a strip having a number of compression elements.

In the illustrated embodiment the compression elements 6, as also shown obliquely in FIG. 3, are embodied as spring elements (fins) bent essentially in a V shape, the closed face of which points downward (V open at the top). The compression elements 6 of a wall section 7, 8, 9 are fastened integrally to a shared strip 10. Only one strip 10 therefore has to be disposed on each of the wall sections 7, 8, 9 to fasten the compression elements 6. This can be done with little outlay and high precision.

As the cook top 1 is inserted into the cut-out C, the compression elements 6 are automatically compressed and cannot catch one another. To remove the cook top 1, it is only necessary to push it upward counter to its weight and the pressure forces of the compression elements 6.

FIG. 4 shows a sectional side view of two cook tops 1, 11 inserted adjacently into a cut-out C2 in a work top A. FIG. 5 shows a sectional view along a surface of the work top A looking down onto the cook tops 1, 11 inserted into the work top A. The two cook tops 1, 11 abut with their adjacent edge sections against one another. The compression elements 6 are laterally shorter than the edge 3 and therefore do not overlap. To prevent the front section and rear section of the edge 3 being offset from one another, an intermediate wall 12 is disposed between the two cook tops 1, 11, in which the opposing compression elements 6 of the two cook tops 1, 11 can engage. To this end, as shown obliquely in FIG. 6, the intermediate wall 12 is embodied for example as a profile with an inverted U-shaped cross section. Introduced into the intermediate wall 12 on each side are recesses 13, which correspond to the compression elements 6, it being possible for the compression elements 6 to engage in particular freely in said recesses 13. If the cook tops 1, 11 are offset from one another along the edges 3, the compression elements 6 of at least one of the cook tops 1, 11 cannot engage and this is remedied by the repositioning of the cook top 1, 11 by a service mechanic. The compression elements 6 engaged in the intermediate wall 12 are in a form fit with the recesses 13 and prevent an offset.

For example the cook top 1 can first be inserted into the work top A, then the intermediate wall 12 can be inserted so that the respective compression elements 6 of the cook top 1 engage in the recesses 13. The cook top 11 is then inserted so that its corresponding compression elements 6 engage in the recesses 13 that are then present on the other face of the intermediate wall 12. This allows particularly simple adjustment.

Figure 7:
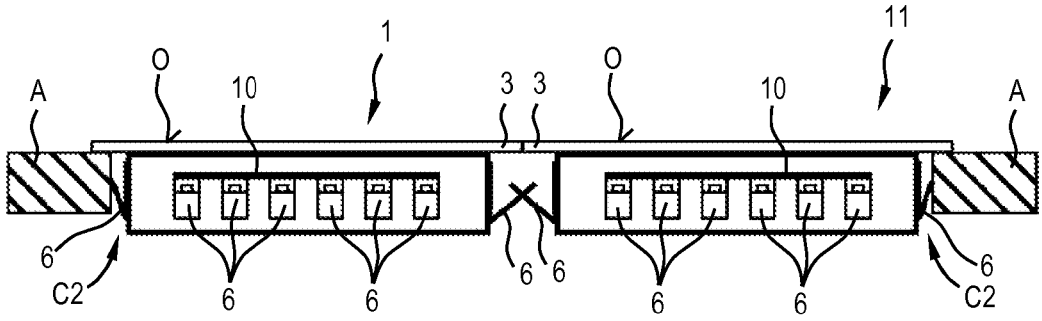
FIG. 7 shows a sectional side view of two further cook tops inserted adjacently into a work top.
Figure 8:
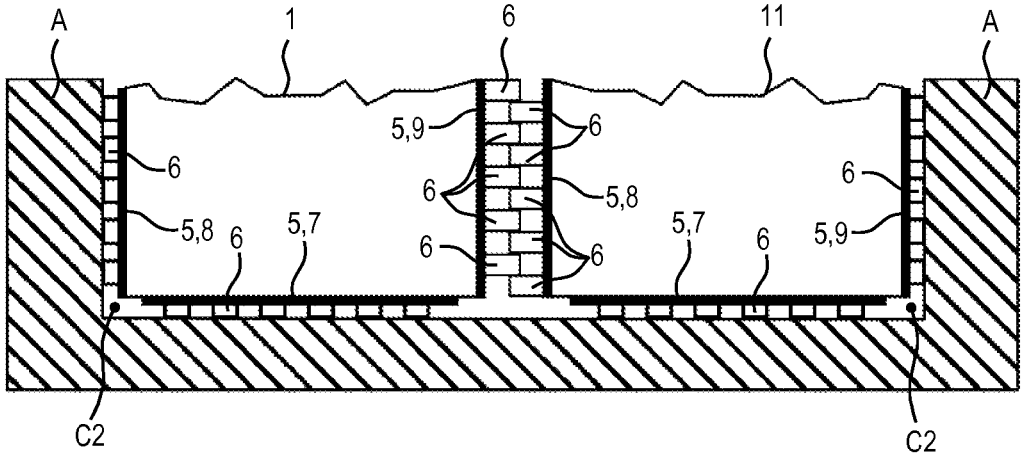
FIG. 8 shows a sectional view along a surface of the work top looking down on the cook tops from FIG. 7 inserted into the work top.

FIG. 7 shows a sectional side view of two cook tops 1 and 11 inserted adjacently into the work top A. FIG. 8 shows a sectional view along a surface of the work top A looking down on the cook tops 1, 11 from FIG. 7 inserted into the work top A. In contrast to FIGS. 4 to 6, the compression elements 6 now extend laterally over the edge 3. For example the compression elements 6, if they are present as bent spring elements, can be bent to a correspondingly large degree and/or far outward. This allows opposing compression elements to mesh with one another when the associated cook tops 1, 11 are positioned adjacent to one another. To achieve flush edges, adjacent compression elements 6 can be spaced apart from one another by an interval, which corresponds to their width. The compression elements 6 and in this instance the strips 10 too should also be offset from one another by a half period. For example the compression elements 6 of the left wall section 8 of the right cook top 11 can be offset from the compression elements 6 of the right face 9 of the left cook top 1 by a half period. There is then no need for an intermediate wall.

The present invention is of course not limited to the illustrated exemplary embodiments.

REFERENCE CHARACTERS

1 Cook top
2 Housing
3 Edge
4 Outer face
5 Peripheral side wall
6 Compression element
7 Front face
8 Left face
9 Right face
10 Strip
11 Cook top
12 Intermediate wall
13 Recess
A Work top
C Cut-out
C2 Cut-out
O Upper face

The invention claimed is:

1. A system having a number of cooking appliances insertable adjacent to one another into a cut-out in a work top, wherein each of at least two adjacently disposed cooking appliances includes a peripheral side wall having four wall sections, each of the wall sections having an outer face, and at least one resiliently deformable compression element provided on each outer face, and at least one intermediate wall disposed between the cooking appliances, said intermediate wall having at least one recess on each side thereof which corresponds to the at least one resiliently deformable compression element of the cooking appliances such that the at least one resiliently deformable compression elements engage in the at least one recess.

2. The system of claim 1, wherein the compression elements are introduced in the at least one recess essentially in the absence of a force fit between them.

3. A method for mounting two cooking appliances that can be disposed adjacently in a shared cut-out in a work top, with each of the cooking appliances having a peripheral side wall with four wall sections, said method comprising:

inserting a first of the two cooking appliances into the cut-out;

arranging an intermediate wall on a free face of the first cooking appliance so that compression elements of the first cooking appliance adjoining the intermediate wall engage in a first group of recesses in the intermediate wall; and inserting a second of the two cooking appliances into the cut-out so that compression elements of the second cooking appliance adjoining the intermediate wall engage in a second group of recesses in the intermediate wall.

4. A method for mounting two cooking appliances that can be disposed adjacently in a shared cut-out in a work top, with each of the cooking appliances having a peripheral side wall with four wall sections, said method comprising:

inserting a first of the two cooking appliances into the cut-out; and inserting a second of the two cooking appliances into the cut-out adjacent to the first cooking appliance so that opposing compression elements of the two cooking appliances mesh with one another.

5. The method of claim 3, wherein inserting the second of the two cooking appliances comprises abutting the first and second cooking appliances with their adjacent edges against one another.

6. The method of claim 5, wherein abutting the first and second cooking appliances comprises abutting the first and second cooking appliances such that the respective compression elements of the first and second cooking appliances do not overlap a respective edge.

7. A system, comprising:

a work top having a cut-out;

a first cooking appliance insertable into the cut-out, the first cooking appliance including peripheral side walls each having an outer face with resiliently deformable first compression elements;

a second cooking appliance insertable into the cut-out laterally adjacent to the first cooking appliance, the second cooking appliance including peripheral side walls each having an outer face with resiliently deformable second compression elements, wherein the resiliently deformable first compression elements and the resiliently deformable second compression elements on adjacent peripheral sidewalls mesh with one another when the first and second cooking appliances are adjacent to each other in the cut-out.

8. The system of claim 7, wherein the resiliently deformable first compression elements and the resiliently deformable second compression elements on peripheral sidewalls adjacent to the work top pushes against the work top when the first and second cooking appliances are inserted therein.

9. The system of claim 7, wherein the resiliently deformable first compression elements and the resiliently deformable second compression elements are respectively configured in the form of a bent spring element.

10. The system of claim 9, wherein the spring element is bent in a V shape.

11. The system of claim 9, wherein the spring element is bent in a U shape.

12. The system of claim 9, wherein the spring element has a closed face which points downward.

13. The system of claim 7, wherein the first and second cooking appliances abut with their adjacent edges against one another.

14. The system of claim 13, wherein the resiliently deformable first compression elements and the resiliently deformable second compression elements overlap a respective edge.

15. The system of claim 7, wherein adjacent the resiliently deformable first compression elements and the resiliently deformable second compression elements are spaced apart from one another by an interval.

16. The system of claim 15, wherein the interval corresponds to the width of the resiliently deformable first compression elements and the resiliently deformable second compression elements.

17. The system of claim 16, wherein the resiliently deformable first compression elements and the resiliently deformable second compression elements are offset from one another by a half period.

* * * * *